US006052997A

United States Patent [19]

Rosenblatt

[11] Patent Number: 6,052,997

[45] Date of Patent: Apr. 25, 2000

[54] REHEAT CYCLE FOR A SUB-AMBIENT TURBINE SYSTEM

[76] Inventor: Joel H. Rosenblatt, Mile Marker 24.5 Royal Palm Plz., Summarland Key, Fla. 33042

[21] Appl. No.: 09/146,527

[22] Filed: Sep. 3, 1998

[51] Int. Cl.[7] ..... F01K 7/34

[52] U.S. Cl. ..... 60/653; 60/677; 60/679

[58] Field of Search ..... 60/650, 651, 653, 60/677, 679

[56] References Cited

U.S. PATENT DOCUMENTS

| | | | |
|---|---|---|---|
| 4,090,361 | 5/1978 | Terry et al. . | |
| 4,330,998 | 5/1982 | Nozawa . | |
| 4,444,015 | 4/1984 | Matsumoto et al. | 60/651 X |
| 4,479,350 | 10/1984 | Newton et al. . | |
| 4,503,682 | 3/1985 | Rosenblatt . | |
| 4,573,321 | 3/1986 | Knaebel . | |
| 5,007,240 | 4/1991 | Ishida et al. . | |
| 5,029,444 | 7/1991 | Kalina . | |
| 5,421,157 | 6/1995 | Rosenblatt | 60/651 X |
| 5,440,882 | 8/1995 | Kalina | 60/651 X |
| 5,548,957 | 8/1996 | Salemie | 60/651 X |
| 5,555,731 | 9/1996 | Rosenblatt . | |
| 5,649,426 | 7/1997 | Kalina et al. . | |

*Primary Examiner*—Hoang Nguyen
*Attorney, Agent, or Firm*—Jacobson, Price, Holman & Stern, PLLC

[57] ABSTRACT

An improved combined cycle low temperature engine system is provided in which a circulating expanding turbine medium is used to recover heat as it transverses it turbine path. The recovery of heat is accomplished by providing a series of heat exchangers and presenting the expanding turbine medium so that it is in heat exchange communication with the circulating refrigerant in the absorption refrigeration cycle. Previously recovery of heat from an absorption refrigeration subsystem was limited to cold condensate returning from the condenser of an ORC turbine on route to its boiler. By utilizing the turbine medium a more efficient system is provided. Specifically, a minimum of a double digit efficiency improvement when compared to the net power output of a conventional low-pressure steam turbine, is obtainable.

10 Claims, 2 Drawing Sheets

REHEAT CYCLE FOR A SUB-AMBIENT TURBINE SYSTEM

The present invention is directed to a reheat cycle for a sub-ambient turbine system. In particular, the present invention is related to a reheat cycle in a combined cycle consisting of an absorption-refrigeration (AR) system and an organic Rankine turbine system.

BACKGROUND OF THE INVENTION

U.S. Pat. No. 4,090,361 (Terry et al.) discloses the use of a heat cycle in a hydride-dehydride-hydrogen cycle (HDH). The HDH cycle is used as a absorption cycle to provide a very low temperature heat sink for a primary power cycle. The heat cycle involves the heating of the hydrogen leaving the hydride reactor bank upon dehydrating so as to impart a higher energy level prior to charging hydrogen to an expansion device for producing work, e.g., turbine.

U.S. Pat. No. 4,503,682, the content of which is expressly incorporated herein by reference as if specifically recited, discloses a combined cycle low temperature engine system. The combined cycle consists of an absorption refrigeration sub-system in combined cycle relationship with organic Rankine turbine systems. The refrigeration sub-system provides a sub-ambient condenser temperature for a turbine cycle, greatly extending the temperature gradient across which the turbine cycle expands, while much of the heat energy rejected from the absorption refrigeration sub-system is internally recovered within the combined cycle system boundaries by regenerative heat transfer to the circulating turbine medium. The internal regenerative heat transfer reduces the net energy consumed to operate the refrigeration sub-system to the point of being less than the power output increase effected for the turbine sub-system.

Extensive computer simulation studies have indicated that the low temperature engine system concept offers a potential double digit increase in power plant turbine cycle efficiencies, as compared with conventional low pressure steam turbine cycles, when the low temperature engine system is employed in an application where it becomes a bottoming cycle replacement for the low-pressure steam turbine in a conventional "all steam" turbine cycle turbine system. It has also been shown to be capable of increasing the power output yield from geothermal resources whose surface plant operating parameters are in a similar thermal regimen to that of a low pressure steam turbine cycle.

U.S. Pat. No. 5,555,731, which is an improvement of U.S. Pat. No. 4,503,682, also expressly incorporated herein by way of reference as if specifically disclosed, provides a power turbine system which employs turbine injectors to supply additional liquid phase turbine medium to the turbine at the elevated temperatures acquired after that liquid medium has performed its function in the low-temperature engine system of absorbing waste heat from the absorption refrigeration subsystem of the low-temperature engine system.

The present invention is the result of a previously unrecognized capability of being able to improve the power output of the low-temperature turbine sub-system that becomes uniquely available to the turbine cycle when expansion of the thermodynamic medium circulating through the turbine enters the sub-ambient temperature range across which its expansion occurs. A well-known characteristics of all heat engine cycles is the fact that the potential output power they can deliver is related to the amount of heat energy that can be input to the expansion process. The higher the temperature at which it is supplied the greater the power output will become. Uniquely, when the turbine cycle of the sub-ambient turbine in this combined cycle enters the sub-ambient portion of its expansion, there are a variety of external heat energy sources, available at temperatures higher than those occurring in the turbine cycle, from which additional heat energy can be supplied to the expanding medium transiting its thermal range,—even including the cooling water temperature in use elsewhere in the turbine plant.

Use of a "reheat cycle" in steam turbine has been practiced for some time. As steam expands to very low pressures, its isentropic path through the turbine converges toward the saturation curve for steam. In order to take maximum advantage of the thermal gradient available at the site of an installation between the best available external site cooling to condense the expanded vapor at the turbine exit, the exit pressure of the steam must enter a high vacuum condition, commonly in the vicinity of 1.5" Hg.abs (3.81 cm.Hg abs.). Generally, as steam approaches the vacuum level, it has already crossed the saturation curve and is in the process of becoming wet,—i.e.—it is in a mixed phase condition with a moisture content approaching a lower limit of 85% quality. Beyond that limit, the moisture content has an adverse impact effect on the turbine blading and increasingly causes a reduction in output power. To overcome the problem, it has been common practice to remove the expanding vapor from the turbine part way through its expansion cycle to send it back to the boiler for a reheat process. When it is returned from the boiler the second time, again at an elevated temperature, it can continue its expansion isentropically from a higher level of superheat, to arrive at its exit pressure at a higher quality level, with a smaller moisture content to adversely affect blading and efficiency.

In the sub-ambient temperature regimen of the turbine in U.S. Pat. No. 4,503,682, at any point below ambient in its cycle, expanding vapor taken from the turbine can be reheated from a variety of heat emitting sources to furnish additional input energy available in its combined cycle environment without resort to the external heat source supplying the system. The original concept of the low-temperature engine system combined cycle is dependent on its capacity to recover heat energy emitted from the associated absorption refrigeration sub-system by internal regenerative heat transfer. Heretofore, that recovery had been limited to recovery of heat emissions from the absorption refrigeration sub-system by use of very cold condensate returning from the condenser of an ORC turbine en route to its boiler as the cooling stream. In effect, it recovered some of the heat ordinarily rejected to ambient cooling water or air temperature as "waste heat" in a conventional "stand alone" absorption refrigeration system.

The present invention recognizes that heat may be recovered by the expanding turbine medium vapor itself, as it traverses its turbine path, before it is ultimately condensed to its liquid phase beyond the discharge point at the bottom of its path through the turbine, when it became useful as a liquid cooling stream en route to its boiler to repeat its cycle.

Furthermore, by the present invention it has been surprisingly found that use of the expanding turbine media itself in a working system designed to operate in accordance with the parameters indicated and employing the sequence of unit operations as diagramed in FIG. 1. will show a minimum of a double digit efficiency improvement when compared with the net power output of a conventional low-pressure steam turbine supplied with the same input steam source as that assumed as the external heat energy source for the alternative combined cycle low temperature engine system referenced. The reheat cycle of the present invention surprisingly offers both an additional mechanism for internal regenerative recovery of heat energy emissions from the absorption refrigeration sub-system otherwise being wasted externally to ambient cooling water, and also a mechanism for increasing the total heat energy input supplied to the expanding vapor circulating through the organic Rankine turbine cycle path in the turbine sub-system.

It is therefore an object of the invention to provide a method of re-heating the turbine medium in a sub-ambient turbine system in combined cycle relationship with an absorption refrigeration system.

It is a further object of the invention to provide a re-heat cycle, in a low temperature engine system combined cycle which is not dependent on the systems' capacity to recover heat energy emitted from the associated absorption refrigeration sub-system by internal regenerative heat transfer.

It is another object of the present invention to provide a heat and energy efficient method for reheating turbine medium in a sub-ambient turbine system by recovering heat from the expanding turbine medium vapor itself.

Further objects of the present invention will become apparent from the following description of the invention and drawings.

SUMMARY OF THE INVENTION

In accordance with a first embodiment of the present invention, an improved combined cycle low temperature engine system is provided, specifically an improvement over U.S. Pat. No. 4,503,682, in which a circulating expanding turbine medium is used to recover heat as it transverses it turbine path. The recovery of heat is accomplished by providing a series of heat exchangers and presenting the expanding turbine medium so that it is in heat exchange communication with the circulating refrigerant in the absorption refrigeration cycle.

In accordance with a second embodiment of the present invention, an improvement in and relating to a combined cycle low temperature engine system is provided having an absorption refrigeration subsystem with a circulating refrigerant medium for providing to the engine system a continuous-flow low temperature heat sink, the circulating refrigeration medium having a refrigerant vapor condensation path and a turbine cycle having a turbine with an upper and lower turbine section each provided with a turbine inlet and turbine outlet and providing a circulating turbine media having a vapor expansion path through a sub-ambient temperature portion of the turbine cycle, the improvement comprising:

a reheat energy source located along the absorption refrigeration subsystem for admitting sub-ambient vapor extracted from the sub-ambient temperature portion of the vapor expansion path in heat exchange communication with condensing refrigerant medium being of a temperature higher than that of the extracted vapor, thereby permitting heat energy from the condensing refrigerant medium to be transmitted to the extracted turbine vapor, said heated vapor being returned by conduit means to the inlet of the turbine at a temperature higher than it possessed at its extraction point to continue its expansion through the remaining portion of the turbine cycle.

In accordance with a third embodiment of the present invention, a method for increasing the efficiency of a combined cycle low temperature engine system having a turbine cycle and circulating turbine media is provided which comprises recovering heat with the expanding turbine media as it traverses a turbine path within the turbine cycle.

DESCRIPTION OF PREFERRED EMBODIMENTS

The present invention represents an application for the combined cycle system intended to become a bottoming cycle replacing the low pressure steam turbine in a conventional steam turbine system of a power plant installation. The external heat energy input source to the combined cycle system is therefore steam at the pressure and temperature at which it would have been directly supplied to the low-pressure steam turbine, generally about 75 psia (5.27 kg/sq.cm.) pressure and at a temperature of about 420 degrees F. (215.5 degrees C.), to be isentropic with its commonplace ultimate exhaust pressure at 1.5 ins (3.81 cm) Hg.abs., and 85% quality.

The absorption refrigeration sub-system exemplified employs the most common industrial scale absorption refrigeration system in current service with ammonia as the refrigerant and water as the absorbate; however, the use of any other pairing of refrigerant and absorbate might be employed in an embodiment that is suitable for the thermal regimen of the application without altering the purpose and intent of the invention. Similarly, propane has been assumed to be the thermodynamic medium circulating in the sub-ambient organic Rankin turbine cycle although other turbine media may be employed in other embodiments without affecting the principles on which the invention is based. Examples of other media for the refrigerant cycle include, but are not limited to hydrogen, ammonia/sodium thiocyanate and the like. Examples of other turbine cycle media include, but are not limited to, hydrocarbon media such as iso-butane, butane, iso-pentane and the like.

In ammonia/water absorption refrigeration systems it is common to refer to the strong solution concentration formed in the absorber as "strong aqua" and the weakened solution concentration left in the generator, after some refrigerant is separated from the "strong aqua", as "weak aqua".

Figure 1:
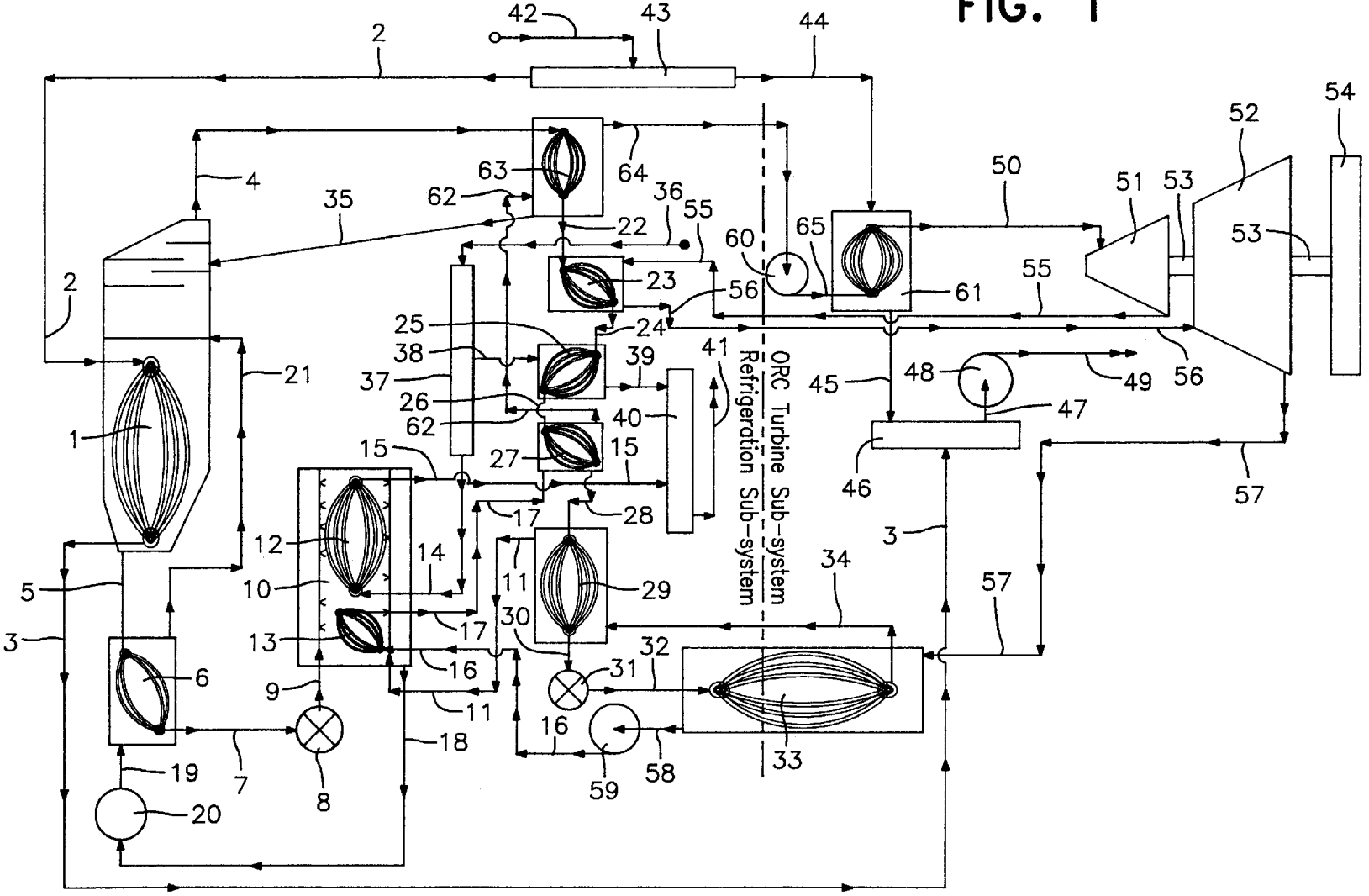
FIG. 1 is a flow diagram of a low temperature engine system in combined cycle relationship with an absorption refrigeration system utilizing a reheat cycle in accordance with the present invention.

FIG. 1 is a system diagram of the two sub-systems comprising the low temperature engine system in their combined cycle relationship. In the absorption refrigeration (AR) sub-system, strong aqua is formed in absorber 10 from the mixture of ammonia vapor returned from the evaporator at low pressure via conduit means 11 and weak aqua supplied via conduit means 9 after having passed through expansion valve 8 to reduce it to the same pressure as that of the vapor from the evaporator to permit mixing both in absorber 10. The absorption process is an exothermal one, and the heat evolved must be removed from the mixture by cooling to permit the strong aqua solution to form. Cooling of absorber 10 is illustrated as being made available by two external coolant streams in heat exchange communication with the mixture in the absorber by an upper and lower cooling section within absorber 10. The upper section is supplied with cooling water via conduit means 14 in heat exchange communication with the mixture in absorber 10 (with the cooling water return provided by means of conduit 15), while the lower section is supplied with the much colder coolant stream of turbine condensate in heat exchange communication with the mixture via conduit means 16, after its having partially been cooled by cooling water. The turbine medium condensate then leaves via conduit means 17. Use of that very cold coolant in the lower portion of the absorber permits a more highly concentrated strong aqua solution to be formed at a sub-ambient temperature at the low pressure operating condition in absorber 10.

The strong aqua solution formed in absorber 10 leaves via conduit means 18 at the low pressure existing in the absorber, and enters pump 20 where it is pumped to the higher pressure at which the generator operates. Pump 20 delivers the high pressure strong aqua solution to aqua heat exchanger 6 via conduit means 19. Aqua heat exchanger 6 receives the cold strong aqua solution from pump 20 via conduit means 19 and the hot weak aqua solution from the generator via conduit means 5. The two streams pass each other in heat exchange communication which allows the transfer of heat energy from the hot weak aqua solution to the cold strong aqua solution. The cooled weak aqua solution leaves via conduit means 7 to be delivered to expansion valve 8, and the warmed strong aqua solution leaves via conduit means 21 to be delivered thereby to generator 1.

Generator 1 receives strong aqua solution from conduit means 21. Generator 1 is also equipped to receive external heat energy input from the external steam supply source via conduit 2 in heat exchange communication with the solution in generator 1. Steam condensate exits generator 1 via conduit 3. The input heat energy received from the external heat energy source releases some of the ammonia refrigerant from the strong aqua solution producing a vapor product containing the ammonia refrigerant separated from the strong aqua solution. That vapor leaves generator 1 via conduit 4. The weak aqua remainder after the ammonia vapor has been separated (a distillation process) is returned to the absorber via conduit 5 to repeat its cycle.

The vapor leaving via conduit 4 also contains a partial pressure of water vapor mixed with the ammonia vapor. The vapor mixture enters rectifier 63 in heat exchange relationship with the still cold turbine medium condensate which enters rectifier 63 via conduit means 62 and leaves via conduit means 64. As the mixed vapor cools, the partial pressure of water vapor that accompanied the refrigerant vapor leaving generator 1 is condensed before the ammonia. As it condenses, a portion of the ammonia vapor is also absorbed by it, and the resultant ammonia/water solution is returned to the generator via conduit 35, the reflux fraction of the distillation process. Upon further cooling, the superheat content of the remaining ammonia vapor is removed by the coolant stream and saturation temperature for the pressure of the ammonia vapor is reached.

At this point, a succession of heat exchangers are presented in the system diagram of FIG. 1, each representing a further cooling stage of the process of getting the high pressure high temperature refrigerant vapor received from generator 1 to be progressively desuperheated, condensed to its liquid phase, and sub-cooled as much as possible before being supplied to the pressure reducing valve for admission to the evaporator. The set of heat exchangers are illustrated in FIG. 1 as a set of unit processes arranged one below the other in a sequence of descending heat energy content as the refrigerant is cooled. Desuperheating is accomplished in rectifier 21 as described. The vapor, now at or near saturation temperature for its pressure, enters reheater 23 to accomplish the subject matter of the present invention. Turbine medium vapor, extracted from the upper portion 51 of the turbine at a temperature below ambient, is delivered to reheater 23 via conduit 55 to pass in heat exchange communication with the condensing refrigerant vapor entering reheater 23 via conduit 22 and leaving via conduit 24. In the process, the turbine vapor medium acquires heat energy input from the cooling refrigerant vapor and is returned to lower portion 52 of the turbine at an elevated temperature now isentropic for its pressure with respect to exhaust conditions at the exit of turbine section 52.

The refrigerant vapor leaving reheater 23 via conduit 24 is then further cooled in ammonia condenser 25 by being placed in heat exchange communication with cooling water supplied to ammonia condenser 25 via conduit means 38 and leaving via conduit means 39. In the process, the remainder of the latent heat of condensation may be removed from the refrigerant stream and the refrigerant leaves condenser 25 approximately in its completely liquid phase. What remains may then be removed in sub-cooler 27 along with an amount of sub-cooling heat energy contained in the liquid phase below saturation temperature for its pressure,—up to the limit of the cooling capacity of the turbine condensate supplied to sub-cooler 27 via conduit means 17 in heat exchange communication with the refrigerant fluid passing therethrough. The now warmer turbine condensate leaves sub-cooler 27 via conduit 26 and the sub-cooled refrigerant liquid leaves via conduit means 28 to enter ammonia pre-cooler 29.

Cooling water from a cooling tower (not shown) is supplied to the turbine plant via conduit 36 and distributed to wherever it is needed by cooling water manifold 37. That manifold supplies conduit means 14 for the absorber requirement and conduit means 38 for the ammonia condenser requirement. Spent cooling water is returned from the absorber 10 via conduit means 15 and from the ammonia condenser 25 via conduit means 39 to a cooling water return manifold 40. From there it is returned to the cooling tower (not shown) via conduit means 41.

Use of an ammonia pre-cooler as shown in FIG. 1 is a commonly used auxiliary device in ammonia/water absorption refrigeration systems. Cold returning refrigerant vapor from the evaporator is passed in heat exchange communication with the liquid phase ammonia refrigerant en route to the expansion valve for release into the evaporator. The cold vapor further sub-cools the liquid refrigerant prior to its use to develop refrigeration capacity in the evaporator. The colder the level of sub-cooling that can be developed, the greater the refrigeration capacity will become when it is ultimately released into the evaporator. The slightly warmed low pressure vapor leaves ammonia pre-cooler 29 via conduit 11 for return to absorber 10. The sub-cooled ammonia liquid leaves ammonia pre-cooler 29 via conduit means 30 to enter expansion valve 31 and to the evaporator 33 via conduit means 32. The pressure of the liquid ammonia stream is sharply reduced to evaporator pressure by passage through expansion valve 31 which causes flash evaporation of the liquid phase ammonia to a vapor in evaporator 33. Evaporator 33 is also the condenser for the associated turbine sub-system of the combined cycle. The refrigeration capacity developed in the evaporator absorbs the heat of condensation of the turbine medium entering evaporator/condenser 33 via conduit means 57 in heat exchange communication with the flashed refrigerant vapor. The refrigerant vapor leaves via conduit means 34 for return to ammonia pre-cooler 29 described above.

In the above description of processes occurring in the absorption refrigeration sub-system, it should be noted that several opportunities to maximize internal heat recovery between the two sub-systems of the combined cycle exist. In the absorber 10, the amount of exothermal heat recovered by cold turbine medium in the lower end may be maximized by controlling the amount of cooling water supplied to the upper end up to the limit of assuring a minimum approach difference between the cooling turbine medium stream and the strong aqua solution formation taking place. An additional tube bundle might also have been introduced in the absorber to provide heat exchange communication means to permit a portion of the evolving exothermal heat to be recovered by extracted turbine medium vapor as another potential source of reheat energy. Similarly, by controlling the supply of cooling water to ammonia condenser 25, portions of the latent heat being removed at constant temperature may be removed successively by reheater turbine vapor flow, and sub-cooler turbine condensate flow, up to the limit of their cooling capacity, leaving only a minimum amount of the remainder to be removed by cooling water flow between those abutting two unit processes. The actual functions of the series of heat exchange processes will be seen to overlap at their boundaries limited only by the need to maintain minimum approach differences to assure heat transfer taking place.

Finally, tracing the associated organic Rankine turbine sub-system, the propane turbine medium having acquired the maximum available feed stream heating after leaving rectifier 63 via conduit means 64 enters boiler feed pump 60. Pump 60 supplies the propane liquid to boiler 61 via conduit means 65 at the intended turbine medium supply pressure. An external heat source steam (not shown) enters the system via conduit 42 through manifold 43 and is supplied to boiler 61 via conduit 44 in heat exchange communication with the propane turbine medium passing there through. Steam condensate exits boiler 61 via conduit means 45 to manifold 46. The cooled condensate exits manifold 46 via conduit means 47 to pump 48 where it is pumped via conduit 49 to a water heater or boiler (not shown). The heated pressurized turbine medium in its vapor phase exits boiler 61 via conduit means 50 to be supplied to the entry of turbine or upper portion of the turbine 51. The vapor expands isentropically through turbine 51 to arrive at an intermediate pressure and below ambient temperature at the reheat extraction point location of conduit 55. The cool vapor enters conduit means 55 where it is carried to reheater 23. It acquires reheat energy by heat exchange communication with hotter ammonia vapor flowing there through, and the now heated turbine medium vapor is returned at an elevated temperature at approximately the same pressure via conduit means 56 to re-enter the turbine at the entry to the lower portion of the turbine 52.

During the expansion process of the turbine medium through the turbine, the turbine delivers its output work by rotating shaft 53 to drive alternator 54 which delivers output electrical energy to the transmission system for distribution. The turbine medium expands through the remainder of the turbine 52 at a pressure still slightly above ambient (to assure no vacuum conditions in the turbine system) but at a temperature on the order of 100 degrees F. (59 degrees C.) below ambient. That expanded vapor leaves turbine 52 via conduit means 57 to enter turbine sub-system condenser 33 (which is also the evaporator of the absorption refrigeration sub-system of the combined cycle). Propane condensate exits condenser 33 via conduit means 58 to enter condensate return pump 59. Pump 59 pumps the condensate at a pressure high enough to assure its ability to travel through all the piping between there and its return to the boiler feed pump, and to assure that it remain in its liquid phase after acquiring the feed stream heating it will receive along the route described above.

To supply a set of operating parameters for the combined cycle described, with the external heat energy supplied in the form of steam at a pressure of 75 psia (5.27 kg,/sq.cm) and a temperature of 460 degrees F. (237.8 degrees C.), generator operating conditions in the absorption refrigeration subsystem may be established at a pressure of 275 psia (19.3 kg./sq.cm) and a temperature of 320 degrees F. (160 degrees C.). For this condition, the saturation temperature at which ammonia refrigerant will condense will occur at 117.2 degrees F. (47.33 degrees C.). With the absorber and evaporator operating at 10 psia (0.703 kg/sq,cm), the evaporator will deliver refrigeration at a temperature of −41 degrees F. (−40.5 degrees C.), quite adequate to condense the propane turbine medium at −30 degrees F. (−34.4 degrees C.) at its exhaust pressure of 20 psia (1.41 kg/sq.cm). Similarly, the external heat source will enable the propane medium to be delivered from its boiler at a temperature of 320 degrees F. (160 degrees C.) at a pressure isentropic with its reheat temperature at the reheat extraction pressure for its exhaust at 20 psia (1.41 kg/sq.cm). As illustrated, the reheat temperature acquired is an adequate approach difference below saturation temperature for ammonia at 275 psia (19.3 kg./sq.cm.) About 110 degrees F. (43.3 degrees C.) leaving a 140 degree F. (60 degree C.) range across which further expansion in the turbine can take place.

For these parameters, the strong aqua solution concentration leaving the absorber after being cooled to an exit temperature of 50 degrees F. (10 degrees C.) becomes about 35.3% ammonia, and the weak aqua solution remaining in the generator after the ammonia refrigerant vapor fraction has been separated at the operating pressure and temperature of the generator would have an ammonia concentration of 17.6%. Cooling water available at an installation site has been assumed to be at a temperature of 75 degrees F. (30.7 degrees C.), the standard cooling water temperature used as a reference temperature by the Heat Exchanger Institute in establishing performance standards for materials used in fabricating a variety of heat exchanger equipment.

Figure 2:
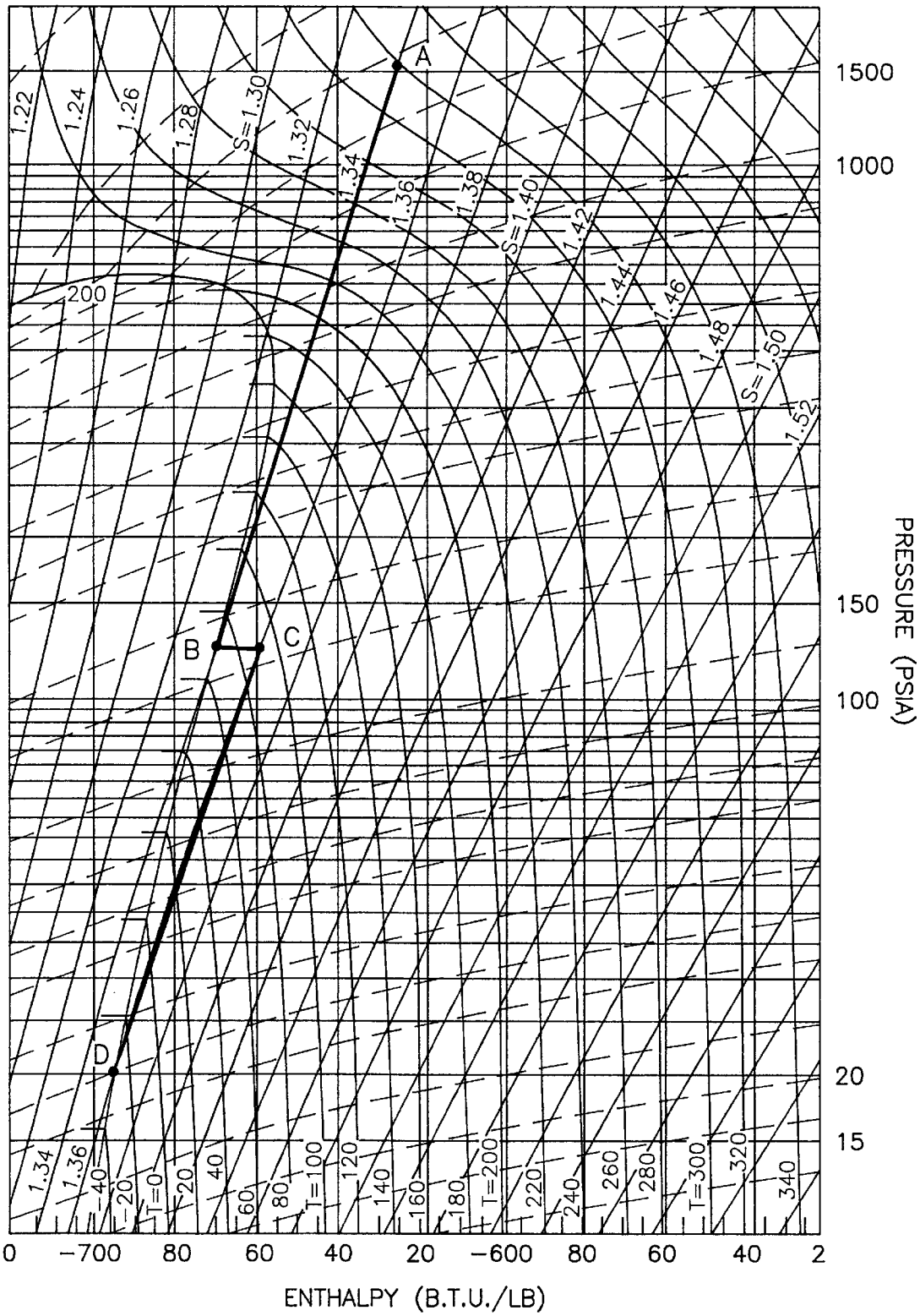
FIG. 2 is a pressure-enthalpy diagram for propane illustrating the vapor expansion path through the system of FIG. 1, including the reheat cycle.

FIG. 2 illustrates the vapor expansion path through the turbine including the reheat process described. The path has been plotted on a pressure-enthalpy diagram for propane as published by Gulf Publishing Company, Houston, Tex. Point "A" indicates the turbine entry conditions of the propane vapor as it left the propane boiler at a pressure of 1,500 psia and a temperature of 320 degrees F. (160 degrees C.). The vapor expands isentropically to a pressure of 125 psia (8.78 kg/sq.cm.) where its temperature has become approximately 65 degrees F. (18.33 degrees C.). It is well below the saturation temperature of condensing ammonia leaving rectifier 21 in FIG. 1. It is extracted at point "B" and supplied to reheater 23 in FIG. 1 where it is heated to a temperature of 80 degrees F. (26.67 degrees C.), and returned to the turbine to re-enter the expansion path at point "C" now isentropic with respect to its exhaust pressure at 20 psia (1.41 kg/sq.cm) at point "D". In the process, it removed its input heat energy from the amount that might otherwise have been wasted to cooling water in ammonia condenser 25 in FIG. 1, and the increase in heat content of the vapor became additional energy available to the turbine for conversion to output power in the remainder of its expansion path below the reheat extraction point.

Although various changes and modifications can be effected in the preferred embodiments of the invention which have been described, it is to be understood that such changes and modifications can be effected without departing from the basic principles which underlie the invention in is most fundamental form. Changes and innovations of this type are therefore deemed to be circumscribed by the spirit and scope of the invention, except as the same may be necessarily limited by the appended claims or reasonable equivalents thereof.

What is claimed is:

1. In a combined cycle low temperature engine system having an absorption refrigeration subsystem with a circulating refrigerant medium for providing to the engine system a continuous-flow low temperature heat sink, the circulating refrigeration medium having a refrigerant vapor condensation path and a turbine cycle having a turbine with an upper and lower turbine section each provided with a turbine inlet and turbine outlet and providing a circulating turbine media having a vapor expansion path through a sub-ambient temperature portion of the turbine cycle, the improvement comprising:

a reheat energy source located along the absorption refrigeration subsystem for admitting sub-ambient vapor extracted from the sub-ambient temperature portion of the vapor expansion path in heat exchange communication with condensing refrigerant medium being of a temperature higher than that of the extracted vapor, thereby permitting heat energy from the condensing refrigerant medium to be transmitted to the extracted turbine vapor, said heated vapor being returned by conduit means to the inlet of the turbine at a temperature higher than it possessed at its extraction point to continue its expansion through the remaining portion of the turbine cycle.

2. The system of claim 1, further comprising an absorber, being part of the absorption refrigeration subsystem, providing at least one of the locations for the reheat energy source.

3. The system of claim 2, wherein the absorber comprises an upper region and a lower region, the upper region being supplied with an external cooling source via a conduit means and the circulating refrigerant medium such that the external cooling source and the refrigerant medium are in heat exchange communication; and the lower portion being supplied with the turbine media and the same circulating refrigerant media that is supplied to the upper portion of the absorber, such that the turbine medium and the refrigerant are in heat exchange communication.

4. The system of claim 2, wherein the refrigerant is partially cooled by the external cooling source before communicating with the turbine medium.

5. The system of claim 2, further comprising a generator being part of the absorption refrigeration subsystem which receives the refrigerant from the absorber, the refrigerant being vaporized within the generator; and a rectifier for receiving the vapor from the generator and also being supplied with turbine media, wherein said refrigerant vapor and said turbine media are in heat exchange communication resulting in cooling and condensing of the refrigerant vapor.

6. The system of claim 5, further comprising a series of heat exchangers located downstream of the rectifier at least as far as the refrigerant vapor path is concerned, said heat exchangers for providing successive desuperheating and condensing of the refrigerant vapor to produce a liquid phase refrigerant.

7. The system of claim 6, further comprising as a first of the series of heat exchangers a first heat exchanger, which is supplied with turbine vapor extracted from the upper turbine section at a temperature which is below ambient temperature and condensing refrigerant from the rectifier each via separate conduit means, wherein the extracted turbine vapor and the refrigerant are in heat exchange communication such that the turbine vapor acquires heat energy input from the cooling refrigerant vapor.

8. The system of claim 7, further comprising a conduit means located between the first heat exchanger and the lower section of the turbine for returning the turbine vapor to the lower turbine section, through the inlet of the lower turbine section, at a temperature which is isentropic for the pressure of the turbine vapor relative to exhaust conditions at the outlet of the lower turbine section.

9. The system of claim 7, further comprising a second heat exchanger as part of the series of heat exchangers positioned downstream of the first heat exchanger and a conduit means positioned between said first and second heat exchangers for supplying refrigerant vapor from the first heat exchanger to the second heat exchanger, said second heat exchanger also being supplied with an external cooling source, said external cooling source and said refrigerant being in heat exchange communication so as to further cool the refrigerant vapor such that the vapor returns to a liquid phase.

10. The system of claim 1, further comprising an evaporator being part of the absorption refrigeration subsystem and also simultaneously being a condenser for the turbine cycle, wherein said evaporator/condenser is supplied with turbine medium from the lower turbine section through said turbine outlet via conduit means and refrigerant medium via a separate conduit means such that the turbine media and the refrigerant are in heat exchange communication within the evaporator/condenser.

* * * * *